United States Patent [19]

Gabrielidis

[11] Patent Number: 4,641,838

[45] Date of Patent: Feb. 10, 1987

[54] TENNIS RACKET WITH RACKET HAVING ADJUSTABLE LENGTH HANDLE

[76] Inventor: Pericles Gabrielidis, 14141 Riverside Dr., #1, Sherman Oaks, Calif. 91423

[21] Appl. No.: 674,660

[22] Filed: Nov. 26, 1984

[51] Int. Cl.[4] ..... A63B 49/08

[52] U.S. Cl. ..... 273/73 J

[58] Field of Search ..... 273/73 J, 75, 81.2, 273/81 R, 67 R, 67 DA, 67 DB, 73 H; 145/61 R, 61 J, 61 K, 62, 63, 64, 75; 74/551.9

[56] References Cited

U.S. PATENT DOCUMENTS

| | | | |
|---|---|---|---|
| 406,666 | 7/1889 | Pratt et al. | 145/64 |
| 416,594 | 12/1889 | Goddard | 145/61 R |
| 592,176 | 10/1897 | Starrett | 145/64 |
| 871,416 | 11/1907 | Kleeman | 145/61 R |
| 1,730,820 | 10/1929 | Holden | 273/73 J |
| 1,937,787 | 12/1933 | Robinson | 273/73 H |
| 2,701,379 | 2/1955 | Balistreri | 273/81.2 X |
| 3,501,148 | 3/1970 | Cheris et al. | 273/53 J |
| 3,582,072 | 6/1971 | Stueck | 273/73 J |
| 3,674,267 | 7/1972 | Hollis | 273/75 |
| 3,833,219 | 9/1974 | Dean | 273/75 |
| 3,856,603 | 12/1974 | Schaefer et al. | 273/73 J X |
| 3,931,968 | 1/1976 | Hedberg | 273/73 J X |
| 3,968,965 | 7/1976 | Frenkel et al. | 273/75 X |
| 4,265,450 | 5/1981 | Drake et al. | 273/73 J X |
| 4,545,584 | 10/1985 | Adam | 273/73 J |

*Primary Examiner*—Richard C. Pinkham
*Assistant Examiner*—Matthew L. Schneider
*Attorney, Agent, or Firm*—Allan M. Shapiro

[57] ABSTRACT

Tennis racket has conventional strings across an open frame which terminates in a straight shank. A handle has a plurality of sections which are flexibly fastened together to clamp on the shank at a selected lengthwise position. A flexible grip material is wrapped around the handle to clamp it in place on the shank so that the handle is secured in place for use.

26 Claims, 9 Drawing Figures

TENNIS RACKET WITH RACKET HAVING ADJUSTABLE LENGTH HANDLE

BACKGROUND OF THE INVENTION

This invention is directed to a tennis racket with an adjustable length handle which can be located in the desired position and clamped in place with the grip.

The conventional tennis racket has an open frame with strings across and has a handle fixed thereto. Tennis rackets with various fixed lengths are available on the market so that the player may buy a racket with a handle of a length which he believes most suitable. It is clear that as a young tennis player grows, with increasing arm length and increasing strength, he continually needs a longer handle on his racket. However, there are other situations in which adjustment of the length of the tennis racket is desirable. A longer handle gives more power by the player to the ball while a shorter handle gives him more control of the ball. A player who has been out of practice for awhile finds that he has less control. Therefore, it is desirable to shorten the handle to gain that control until he practices sufficiently and then, upon regain of control, he can lengthen the handle for the increase in power.

Some experienced players will find that changing the handle length will improve his game against particular opponents and on different kinds of surfaces. Only a short handle change is necessary to cover the various situations, with a 2-inch handle length change being an example of the maximum change that would be desired in these kinds of circumstances. For some players, a greater change may be. helpful, but since the change in control and power is large with small handle length changes, a nominal 2-inch maximum is all that is usually required. Thus, there is a need for a tennis racket having a handle which can be positioned to a desired length and can be readjusted in length as desired.

SUMMARY OF THE INVENTION

In order to aid in the understanding of this invention, it can be stated in essentially summary form that it is directed to a tennis racket with an adjustable length handle. The tennis racket has open frame with a shank secured thereto and extending therefrom. A handle embraces the shank and is clamped thereon by means of the grip wound around the handle so that the handle can be located at selected positions along the length of the shank and secured thereon.

It is, thus, an object and advantage of this invention to provide a tennis racket having a conventional open frame with strings thereon and having a shank secured thereto. The handle embraces the shank and can be positioned therealong. When in selected position, it is clamped thereon by means of wrapping therearound of the grip.

It is another object and advantage of this invention to provide a tennis racket with adjustable length handle so that the length of the tennis racket handle can be adjusted with growing of the tennis player and can be adjusted for more power or more control in accordance with the size, strength and experience of the player. Furthermore, it can be adjusted in accordance with the desires of the player with respect to his opponent and the type of surface on which the tennis match is being played.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENTS

Figure 1:
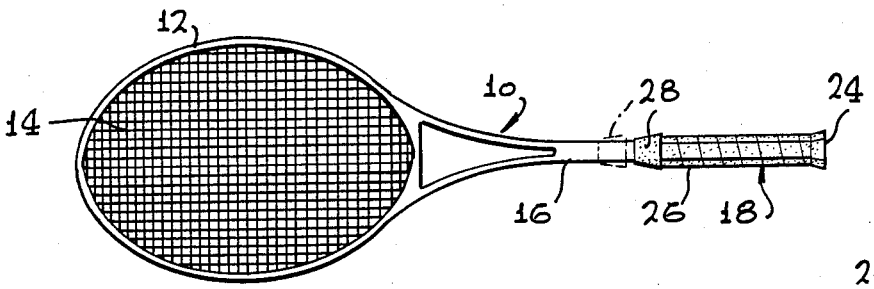
FIG. 1 is a side-elevational view of a tennis racket having the first preferred embodiment of the adjustable length handle of this invention incorporated therewith.
Figure 2:
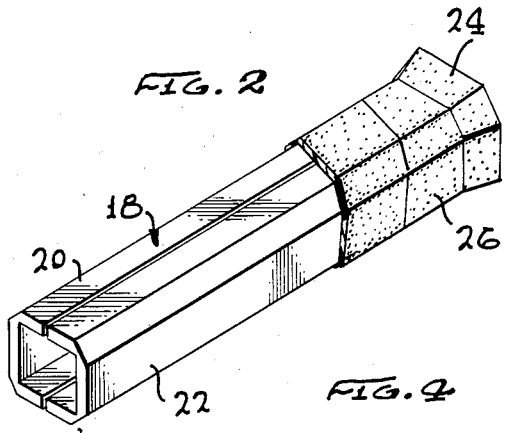
FIG. 2 is an exploded isometric view thereof, with parts broken away.
Figure 3:
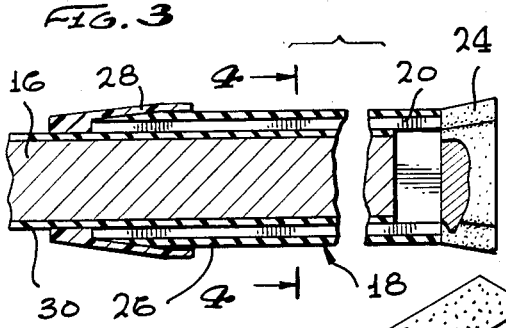
FIG. 3 is a longitudinal section through a portion of the handle, grip and shank, with parts broken away and parts taken in section.
Figure 4:
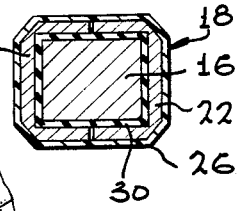
FIG. 4 is a section taken generally along the line 4—4 of FIG. 3.
Figure 4:
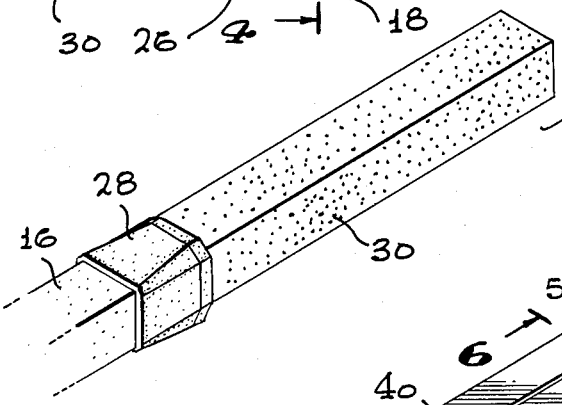

Tennis racket 10 is shown in FIG. 1. It has an open frame 12 with strings 14 thereacross. The size and shape meet the requisite standards. The frame may be made of wood, metal or loaded synthetic polymer composition material. Shank 16 is secured to the frame. As is seen in FIGS. 2, 3 and 4, shank 16 is of uniform cross-section, and the cross-section is preferably rectangular. Shank 16 is permamently secured to the open frame and serves as a structure upon which the handle is slidably mounted.

Handle 18 is seen in FIGS. 2, 3 and 4 and is formed of a pair of C-shaped handle sections 20 and 22. As seen in FIGS. 2 and 4, the handle sections face each other and embrace handle shank 16. Since the handle shank is of uniform cross-section, the opening defined by the two facing handle sections is of the same cross-section, with just enough clearance to slide the handle lengthwise along the shank. There is a slight clearance between the facing parts of the two handle sections so that they may be clamped onto the shank later. The handle is moved to the desired position on the shank to produce the desired handle length and is clamped thereon.

Figure 9:
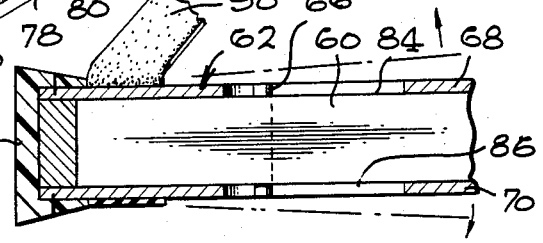
FIG. 9 is a longitudinal section through the handle, showing the flexibility of the handle.

End cap 24 is secured to the outer end of the handle and attaches the two handle sections together. FIGS. 3 and 9 show a block within the cap and between the handle sections. The cap is shown as secured to the handle sections with the block therebetween. This construction is such as to permit the free end of the handle sections, when wrapped grip 26 is unwrapped, to spread sufficiently to permit the handle sections to be moved longitudinally along the shank 16 to the selected position. These parts permanently join the handle sections, but permit the handle sections to be spread when the grip is unwrapped. Grip 26 is attached on its outer end to the end cap and is spirally wrapped around the two handle sections to clamp them onto the handle shank. Grip 26 is of a strong, flexible material such as leather, although it may be a similar synthetic material. The outer surface of the handle sections may be shaped, in this case, octagonally, to provide the desired grip configuration. When the grip 26 is fully wound on the handle, its otherwise loose forward end is held in place by front cap 28. Front cap 28 is generally in the shape of a hollow cone having a rectangular forward opening which embraces shank 16 and a conical opening toward the outer end of the handle which embraces around both the handle and the grip to maintain the otherwise free end of the grip in place. The resiliency of the grip material, together with the sizes and shapes of the shank and handle sections is sufficient to clamp the handle in place on the shank to maintain the handle in place during play. If desired, a friction surface 30 may be provided on the outer surface of shank 16 in order to enhance the frictional interengagement between the handle and the shank to maximize security.

As previously stated, the nominal maximum range of adjustment is only 2 inches so that a considerable amount of overlap is provided between the handle and the shank, even at maximum handle length. The handle may be quickly and easily adjusted to a new length position by sliding front cap 28 forward, unwrapping grip 26, repositioning the handle on the shank, rewinding the grip under tension, and finally sliding the front cap over the otherwise free end of the grip to secure it in place. In this way, the length of the handle can be quickly and easily adjusted with an infinite number of available positions.

Figure 5:
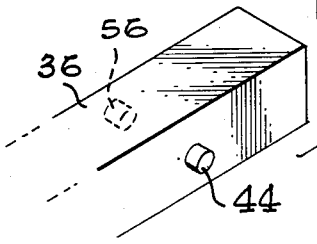
FIG. 5 is a view similar to FIG. 2, showing a second preferred embodiment of the tennis racket with adjustable length handle in accordance with this invention.
Figure 5:
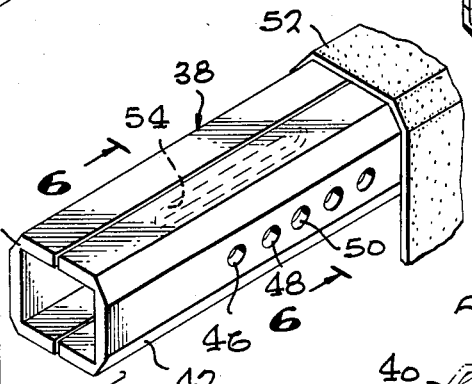
Figure 6:
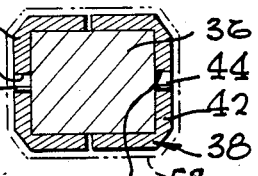
FIG. 6 is a section taken generally along the line 6—6 of FIG. 5, with the handle assembled on the tennis racket shank.

While an infinite number of handle positions is desirable and while even only a quarter inch of handle length change is significant, discrete adjustments are also practical. The second preferred embodiment of the tennis racket with an adjustable length handle is shown in FIGS. 5 and 6 wherein shank 36 is similar to shank 16 and is secured to the frame of the tennis racket. Handle 38 has handle sections 40 and 42 which are facing each other, C-shaped, and similar to the handle sections 20 and 22. Shank 36 is of uniform cross-section, except for pin 44, and is sized to slide within the opening defined within the handle sections. Handle section 42 has a plurality of spaced openings 46, 48 and 50 therein which are longitudinally aligned with the pin 44 and sized to accept the pin.

Handle sections 40 and 42 are attached to the outer end cap, similar to end cap 24, in a manner that they can be sprung apart. They are sprung apart sufficiently wide so that the pin 44 can be placed within the selected openings 46, 48 or 50 (and such further openings as may be desired) to position the handle at a preselected incremental position along the length of the shank. The openings are preferably one-quarter of an inch, or less, apart. When positioned at the desired length, the handle is wrapped with grip 52 so that the handle sections are clamped around the shank. Similarly to the tennis racket 10, a front cap is slid rearward over the forward end of the grip when it is wrapped in place. In this way, incremental handle adjustment is achieved. Also, the presence of pin 44 limits the amount of handle adjustment to the distances and positions provided by the pin-receiving openings in the handle, thus preventing the possibility of exceeding the maximum amount of feasible adjustment as could occur with the version shown in FIGS. 2–4.

Another way to limit the maximum amount of positional adjustment also is shown in connection with the embodiment illustrated in FIGS. 5 and 6 wherein a slot 54 is positioned to extend lengthwise in handle section 40. Pin 56 is positioned to enter into the slot. When such a pin-slot combination is employed, the length of the slot 54 defines the full extent of the adjustment attainable. Elimination of pin 44 then permits infinite positional adjustment of the handle, as in the embodiment of FIGS. 2–4, within the range permitted by the pin 56 and slot 54. Also, with this construction, when the handle is positioned as desired, the grip is wrapped therearound to secure the handle in position on the shank. The front cap is pressed over the forward end of the grip to secure the grip in place, which, in turn, securely clamps the handle on the shank.

Figure 7:
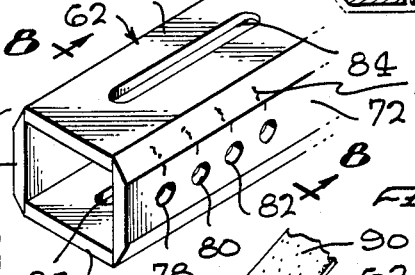
FIG. 7 is a view similar to FIG. 2, showing a third preferred embodiment of the tennis racket with an adjustable length shank in accordance with this invention.
Figure 8:
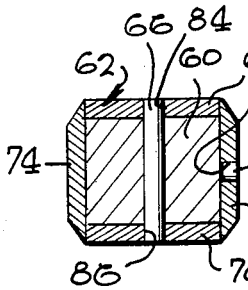
FIG. 8 is a section taken generally along the line 8—8 of FIG. 7, with the handle on the shank.
Figure 8:
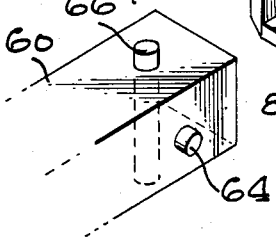

The adjustable length handle construction shown in FIGS. 7, 8 and 9 shows a third preferred embodiment of the adjustable length handle construction. Shank 60 is of uniform cross-section and is preferably rectangular, as is shown. The shank is similar to shank 16 and is attached to the frame of the tennis racket. Handle 62 is formed of four sections, each in the form of a panel, rather than two separate C-shaped sections as described with respect to the adjustable handles of FIGS. 2 and 5. Pins 64 and 66 are at right angles to each other in shank 60, Thus, the sections of the handle must be separated to get them on and off the pins 66 and 64. Those sections thus comprise top and bottom panels 68 and 70 as well as left and right panels 72 and 74, as viewed from the player. These panels are secured into the end cap 76, which is similar to end cap 24 and is flexible to permit spreading apart of the free, forward end of the panels which form the sections of the handle. Left panel 72 has a plurality of openings 78, 80 and 82 which selectively accept pin 64. In addition, top and bottom panels 68 and 70 respectively have slot 84 and 86 therein to receive the ends of pin 66, as is shown in FIG. 8. The panels and the handle can be spread apart and embraced over the pins with the pin 64 going into the selected opening in left panel 72. In view of the clamping character of the grip, it is not necessary for there to be openings in both the left and right panel, but such could be provided if desired.

The panels which form the sections of the handle 62 are configured so they present an interior opening therein which clamps around the shank 60 when the panels are constrained. When they are not constrained, they can be spread apart, as shown in dotted lines in FIG. 9, so that the shank can be placed within the panels of handle 62 so that the slots 84 and 86 engage on pin 66 and pin 64 engages in the selected opening 78, 80 or 82 to determine the longitudinal position of the handle upon the shank. The openings are spaced at the desired longitudinal increment, and, like the openings 46, 48 and 50, the openings 78, 80 and 82 have indicia in association therewith so that the player knows the handle length he is achieving by placing the pin in that particular opening. Indicia 88 is indicated in FIG. 7 with respect to opening 82, and similar indicia are shown in association with the openings in both FIGS. 5 and 7. After the panels are closed down around the shank 60 with the pin 64 in the selected opening, grip 90 is wrapped around the panels so that these sections of the handle clamp upon the shank to firmly secure the handle and shank together. When wrapping is complete, a front cap such as cap 28 is thrust down over the forward otherwise free end of grip 90. With respect to each of these adjustable length handles, the player can select the length he feels is most helpful to him under the particular circumstances of the next game. Since readjustment of the handle length is quick, easy, accurate and secure, he can readjust the length from game to game as circumstances suggest.

It may be noted that, throughout this specification, reference has been made to adjustment of the handle length. Clearly, since the handle is an integral part of the racket, it should be understood that any amount of adjustment of the handle length causes an equal amount of adjustment of the racket length.

While the conventional forward end cap 28 has been described conveniently as a means for securing the end of the leather wrapping which forms the grip, other conventional means such as tape can be used instead This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A tennis racket with an adjustable handle comprising:

an open frame, a shank having an attach end and a free end and having its attached end secured to said open frame, said shank having a substantially uniform cross-section over a portion of is length adjacent its free end;

a handle having two facing C-shaped sections said facing C-shaped sections of said handle having an opening therein of substantially uniform cross-section and substantially the same cross-section as said shank, said sections of said handle embracing said shank and said handle being movable to a selected position along the length of said shank while said sections are spaced apart;

connecting means connected to both said facing C-shaped sections of said handle, said handle being positioned on said shank so that said connecting means lies beyond said free end of said shank for permitting said C-shaped sections to move away from each other, so as to allow said handle to be selectively positioned along said shank and for permitting said handle sections to move toward each other to clamp on said shank, said handle sections being sized and configured so that said sections are spaced from each other when locked on said shank; and a grip wrapped around said handle and urging said sections of said handle against said shank to lock said handle at the selected position on said shank while said sections are spaced apart from each other and do not touch each other at said shank.

2. The tennis racket of claim 1 wherein there is a front cap on said shank, said front cap being slidable on said shank toward said handle to engage over a portion of said grip to hold said grip in wrapped position.

3. The tennis racket of claim 1 wherein said shank is substantially rectangular and said handle sections each comprise a C-shaped section having a substantially rectangular interior, with said C-shaped sections facing each other and spaced from each other so that said C-shaped sections embrace around said shank and are clamped on said shank by said grip.

4. The tennis racket of claim 3 wherein said shank has a high-friction surface thereon.

5. The tennis racket of claim 3 wherein there is a plurality of spaced openings in one of said C-shaped handle sections and there is a pin in said shank, said pin being positioned to enter into one of said openings so that said handle can be placed on said shank in any one of a plurality of incrementally spaced positions.

6. The tennis racket of claim 5 wherein said grip engages over said openings and said pin so as cover said openings and said pin when said grip is wrapped around said handle to clamp said handle into firm embrace on said shank.

7. The tennis racket of claim 3 wherein there is a slot in one of said C-shaped sections and a pin for engagement in said slot so as to limit the range of such positions to the length of said slot.

8. The tennis racket of claim 7 wherein said grip engages over said slot and said pin so as to cover said slot and said pin when said grip is wrapped around said handle to clamp said handle into firm embrace on said shank.

9. A tennis racket with an adjustable handle comprising:

an open frame for carrying strings thereacross, a shank secured to said open frame, said shank having an outer end away from said open frame and being straight and of uniform cross-section toward said outer end;

a handle mounted on said shank, said handle having two C-shaped sections, said sections defining an open-ing therein which receives said shank so that said handle can be placed on said shank at any one of a plurality of selected position to select the position of said handle with respect said open frame, said C-shaped sections of said handle being spaced from each other when embraced on said shank;

connecting means connected to said handle sections for permitting said handle section to be opened while said connecting means is connected to said handle section so as to permit positioning of said handle on said shank and permit closing of said handle sections to clamp them on the shank at the selected position while spaced from each other; and a flexible grip wrapped around said handle to urge said sections toward said shank so that said handle grasps said shank with said handle sections spaced from each other to resist axial motion of said handle with respect to said shank so that the effective length of the tennis racket can be selected and adjusted and retained.

10. The tennis racket of claim 9 wherein there is a plurality of openings in one of said sections and thereis a pin in said shank, said pin engaging in a selected one of said opening to axially restrain said handle with respect to said shank.

11. The tennis racket of claim 9 further including a slot in one of said sections and a pin engaging in said slot so as to limit the range of such position to the length of said slot.

12. The tennis racket of claim 9 wherein said connecting means comprises an end cap, said sections being attached to said end cap so that when said grip is off of said handle sections, said handle sections can move toward an away from each other to clamp on said shank.

13. The tennis racket of claim 12 wherein there is a plurality of openings in one of said handle sections and there is a pin in said shank, said pin engaging in a selected one of said openings so as to position said handle at a preselected position on said shank.

14. A tennis racket with an adjustable handle comprising:

an open frame for carrying strings thereacross, a shank secured to said open frame, said shank having an outer end away from said open frame and being straight and of uniform cross-section toward said outer end;

a handle mounted on said shank, said handle having a plurality of sections, said sections defining an opening therein which receives said shank so that said handle can ge placed on said shank in any one of a plurality of selected positions to select the position of said handle with respect to said open frame, a plurality of openings in one of said handle sections, a pin in said shank, said pin engaging in a selected one of said openings to axially restrain said handle with respect to said shank, indicia related to said openings so that a selected opening can be chosen to predetermine the position of said handle said shank; and a flexible grip wrapped around said handle to urge said sections toward said shank so that said handle grasps said shank to resist axial motion of said handle with respect to said shank so that the effective length of the tennis racket can be selected and adjusted and retained.

15. The tennis racket of claim 14 wherein said shank is substantially rectangular in cross-section and said handle sections comprise four panels, one on each of the sides of said shank, so that said grip wrapped around said handle panels urges said handle panels into clamping relationship with said shank.

16. A tennis racket with an adjustable handle comprising:

an open frame for carrying strings thereacross, a shank secured to said open frame, said shank having an outer end away from said open frame and being straight and of uniform cross-section toward said outer end;

a handle mounted on said shank, said handle having a plurality of sections, said sections defining an opening therein which receives said shank so that said handle can be placed on said shank in any one of a plurality of selected positions to select the position of said handle with respect to said open frame, said handle comprising a pair of facing C-shaped sections and an end cap, said sections being atrached to said end cap so that said C-shaped sections can move toward and away from each other to clamp on said shank, a plurality of openings in one of said handle sections and a pin in said shank, said pin engaging in a selected one of said openings so as to position said handle at a preselected position on said shank and an indicia adjacent each of said openings so that the position of saidhandle on said shank can be preselected; and a flexible grip wrapped around said handle to urge said sections toward said shank so that said handle grasps said shank to resist axial motion of said handle with respect ot said shank so that the effective length of the tennis racket can be selected and adjusted and retained.

17. A racket comprising:

an open frame for carrying strings thereacross, a shank secured to said open frame, said shank having an outer end away from said open frame and being straight and of uniform cross-section toward said outer end;

a handle mounted on said shank, said handle comprising two C-shaped sections facing each other so that said handle sections define a space therebetween and within said two C-shaped sections which receives at least a portion of said staight and uniform cross-sectional portion of said shank toward the outer end of said shank so that said handle can be placed on said shank at any one of a plurality of selected positions to select the position of said handle with respect to said open frame;

connecting means connected to said two C-shaped handle sections for permitting said handle sections to be opened while said connecting means is connected to said handle section so as to permit positioning of said handle in a selected position along the length of said shank and permit closing of said two C-shaped handle sections to clamp said handle sections on said shank at the selected position, said C-shaped handle sections being sized and configured so that there is a space therebetween when said C-shaped handle sections are clamped on said shank; and clamping means engaged on both of said C-shaped handle sections to clamp said handle sections toward each other so that said handle sections grasp at least a portion of said shank engaged within said handle sections to resist axial motion of said handle with respect to said shank so that the effective length of the racket can be selected and adjusted and retained.

18. The racket of claim 17 wherein said portion of said shank having a substantially uniform cross-section is substantially rectangular.

19. The racket of claim 17 wherein said means for clamping comprises a flexible grip wrapped around said handle to urge said C-shaped handle sections toward said shank so that said handle sections grasp said shank.

20. The racket of claim 17 wherein said connecting means is attached to both of said C-shaped handle sections and said connecting means is sufficiently resilient to permit spreading of said C-shaped handle sections when said clamping means is removed from said handle sections to longitudinally position said handle upon said shank.

21. The racket of claim 20 wherein said portion of said shank having a substantially uniform cross-section is substantially rectangular.

22. The racket of claim 21 wherein said means for clamping comprises a flexible grip wrapped around said handle to urge said C-shaped handle sections toward said shank so that said handle sections grasp said shank.

23. A racket comprising:

an open frame for carrying strings thereacross, a shank secured to said open frame, said shank having an outer end away from said open frame, said outer end of said shank being straight and of uniform cross-section;

a handle mounted on said shank, said handle having a plurality of sections, said sections defining an opening therebetween sized and configured to receive said outer end of said shank so that said handle can be placed on said shank at any one of a plurality of selected positions on said shank to select the position of said handle with respect to said open frame;

connecting means connected to said handle sections for permitting said handle sections to be opened while said connecting means is connected to said handle sections so as to permit positioning of said handle on said shank and permit closing of said handle sections on said shank to clamp said handle sections on said shank at the selected position; and a flexible grip grip wrapped around said handle to urge said sections toward said shank so that said handle grasps said shank to resist axial motion of said handle with respect to said shank so that the effective length of the racket can be selected and adjusted and retained.

24. The racket of claim 23 wherein said handle sections comprise two facing C-shaped handle sections and wherein said C-shaped handle sections are spaced from each other when said handle sections are clamped on said shank.

25. The racket of claim 24 wherein said connecting means between said handle sections is a flexible connecting means to permit separating of said handle sections.

26. The racket of claim 25 wherein said connecting means includes an end cap engaged over said handle sections.

* * * * *